US009512636B2

(12) United States Patent
Czeresko, Jr.

(10) Patent No.: US 9,512,636 B2
(45) Date of Patent: Dec. 6, 2016

(54) PADDLE HANDLE WITH CABLE EYE

(71) Applicant: Hansen International, Inc., Lexington, SC (US)

(72) Inventor: Paul J. Czeresko, Jr., Little Mountain, SC (US)

(73) Assignee: Hansen International, Inc., Lexington, SC (US)

( * ) Notice: Subject to any disclaimer, the term of this patent is extended or adjusted under 35 U.S.C. 154(b) by 0 days.

(21) Appl. No.: 15/006,472

(22) Filed: Jan. 26, 2016

(65) Prior Publication Data

US 2016/0273241 A1 Sep. 22, 2016

Related U.S. Application Data

(60) Provisional application No. 62/135,236, filed on Mar. 19, 2015.

(51) Int. Cl.
*E05B 5/00* (2006.01)
*E05B 13/00* (2006.01)

(52) U.S. Cl.
CPC ..... *E05B 5/00* (2013.01); *E05B 13/002* (2013.01)

(58) Field of Classification Search
CPC ..... Y10T 70/5761; Y10T 74/20462; E05B 85/10; E05B 85/16; E05B 5/00; E05B 13/005; E05B 13/002; E05B 85/14; E05B 85/18; E05B 13/101; E05C 3/14
USPC ..... 70/208; 292/210, 228
See application file for complete search history.

(56) References Cited

U.S. PATENT DOCUMENTS

| | | | | |
|---|---|---|---|---|
| D143,238 | S | 12/1945 | Pfefferkorn | |
| 3,576,118 | A * | 4/1971 | Doerrfeld | E05C 1/145 292/153 |
| 3,871,198 | A * | 3/1975 | Miller | E05C 1/145 292/173 |
| D375,671 | S | 11/1996 | Heithe | |
| 5,586,458 | A * | 12/1996 | Weinerman | E05B 5/00 292/240 |
| 6,513,353 | B1 * | 2/2003 | Weinerman | E05B 5/00 292/48 |
| 6,543,821 | B1 | 4/2003 | Weinerman et al. | |
| 6,854,304 | B2 | 2/2005 | Linares | |
| 7,237,812 | B2 * | 7/2007 | Tweedy | E05B 5/00 292/336.3 |
| D622,126 | S | 8/2010 | Burns | |
| D690,186 | S | 9/2013 | Coffin et al. | |
| D759,457 | S | 6/2016 | Czeresko, Jr. | |
| 2003/0111845 | A1 * | 6/2003 | Sadler | E05B 5/00 292/35 |
| 2011/0181055 | A1 | 7/2011 | Hidding et al. | |
| 2014/0042755 | A1 | 2/2014 | Goodman | |
| 2014/0210222 | A1 | 7/2014 | Weinerman et al. | |

* cited by examiner

*Primary Examiner* — Suzanne Barrett
(74) *Attorney, Agent, or Firm* — JK Intellectual Property Law, PA

(57) ABSTRACT

A paddle handle assembly includes a tray, a handle pivotally mounted to the tray, a spring for urging the handle toward an unactuated position with respect to the tray, and an arm integrally formed with the handle. The arm extends through the tray. A distal end of the arm includes a cable eye connector integrally formed with the arm for actuating a securing mechanism on a rear side of the tray.

8 Claims, 5 Drawing Sheets

PADDLE HANDLE WITH CABLE EYE

CROSS-REFERENCE TO RELATED APPLICATIONS

This application claims filing benefit of U.S. Provisional Patent Application Ser. No. 62/135,236 having a filing date of Mar. 19, 2015, which is incorporated herein by reference in its entirety.

TECHNICAL FIELD

The present disclosure relates to a paddle handle latching assembly having a cable eye attachment portion. More particularly, the present disclosure relates to such an assembly having a unitarily constructed handle and cable eye attaching element.

BACKGROUND

Vehicle boxes and compartments with lids or doors have latching assemblies to allow them to be opened and closed as desired. Pivotable or rotatable handles are commonly in use to actuate such assemblies. Many different types of securing mechanisms (e.g., sliding, pivoting, rotating) have been employed to hold the lid or door closed, and to release it when actuated by the handle. In some assemblies, a securing mechanism is employed adjacent the handle. In other assemblies one or more securing mechanisms are employed spaced from the handle. Some such latching assemblies that actuate spaced securing mechanisms may employ a cable, rod or the like to actuate the securing mechanisms. Pivoting of the handle causes the cable or rod to pull or push a part of the securing mechanism to thereby actuate it as desired. The latching assemblies may optionally incorporate a lock to prevent unauthorized actuation of the securing mechanism.

While currently available latching assemblies function well, some such latching mechanisms include complicated actuation elements. Others require complicated and relatively expensive manufacturing of complex shapes to achieve a desired structure. Accordingly, a latching assembly addressing one or more of the above, and/or providing other benefits, would be welcome.

SUMMARY

According to certain aspects of the disclosure, a paddle handle assembly may include, for example, a tray, a handle pivotally mounted to the tray, a spring for urging the handle toward an punctuated position with respect to the tray, and an arm integrally formed with the handle. The arm extends through the tray. A distal end of the arm includes a cable eye connector integrally formed with the arm for actuating a securing mechanism on a rear side of the tray. Various options and modifications are possible.

For example, the paddle handle assembly may further include a double bend at a proximal end of the arm for creating an offset between the cable eye connector and a side of the handle.

Also, the paddle handle assembly may further include a locking mechanism mounted to the handle for preventing actuation of the handle relative to the tray. The tray may include a catch for receiving a locking arm of the locking assembly. Further, the catch may be formed integrally with the tray.

BRIEF DESCRIPTION OF THE DRAWINGS

More details of the present disclosure are set forth in the drawings.

DETAILED DESCRIPTION

Figure 1:
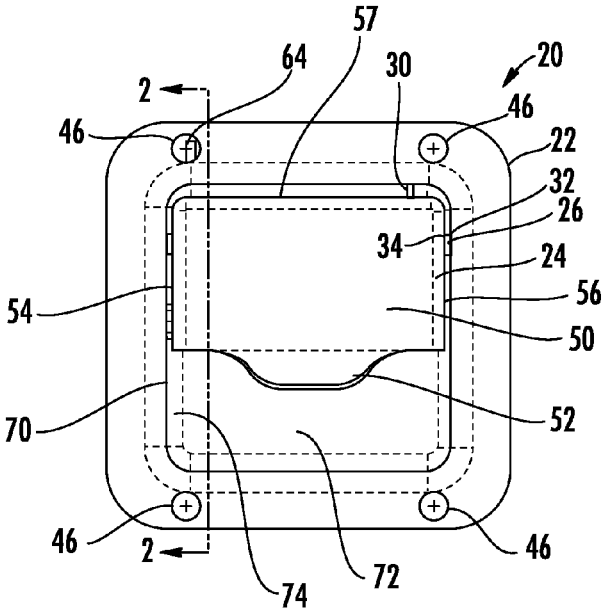
FIG. 1 is a front view of a first (non-locking) embodiment of a paddle handle assembly with cable eye according to the present disclosure.
Figure 2:
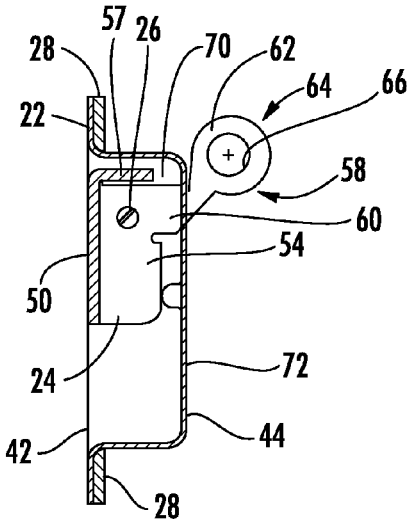
FIG. 2 is a cross-sectional view of the paddle assembly handle taken along lines 2-2 in FIG. 1.
Figure 3:
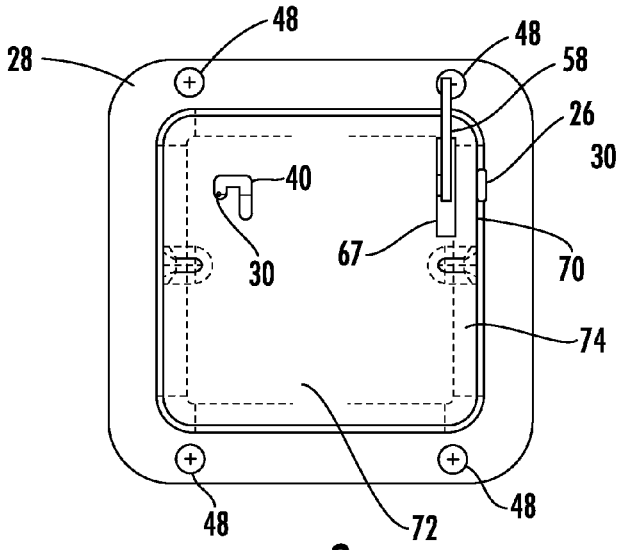
FIG. 3 is a rear view of the paddle handle assembly of FIG. 1.
Figure 4:
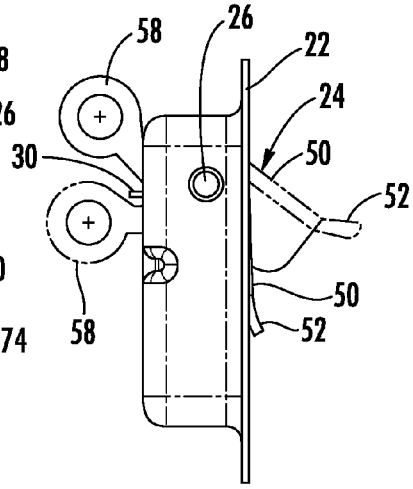
FIG. 4 is a side view of the paddle handle assembly of FIG. 1 showing the handle assembly in unactuated (solid lines) and actuated (dotted lines) positions.
Figure 5:
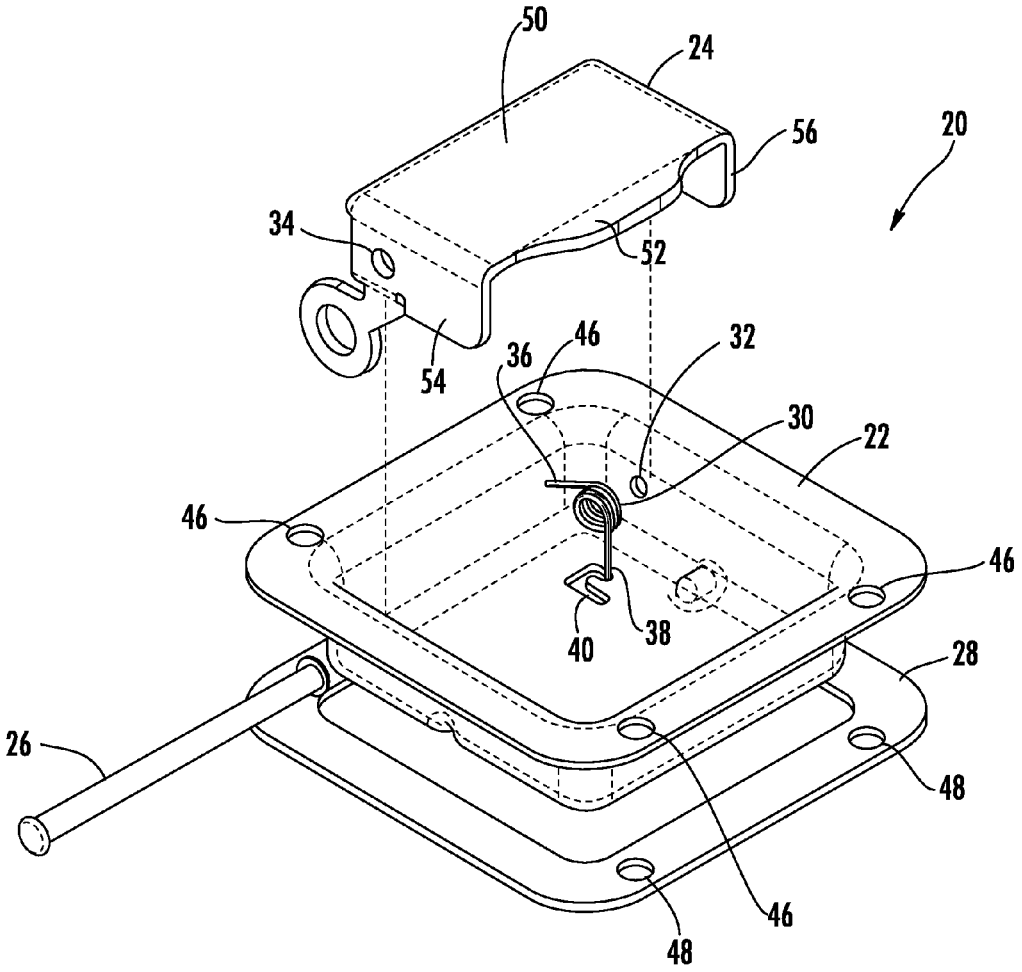
FIG. 5 is an isometric, exploded view of the paddle handle assembly of FIG. 1.
Figure 6:
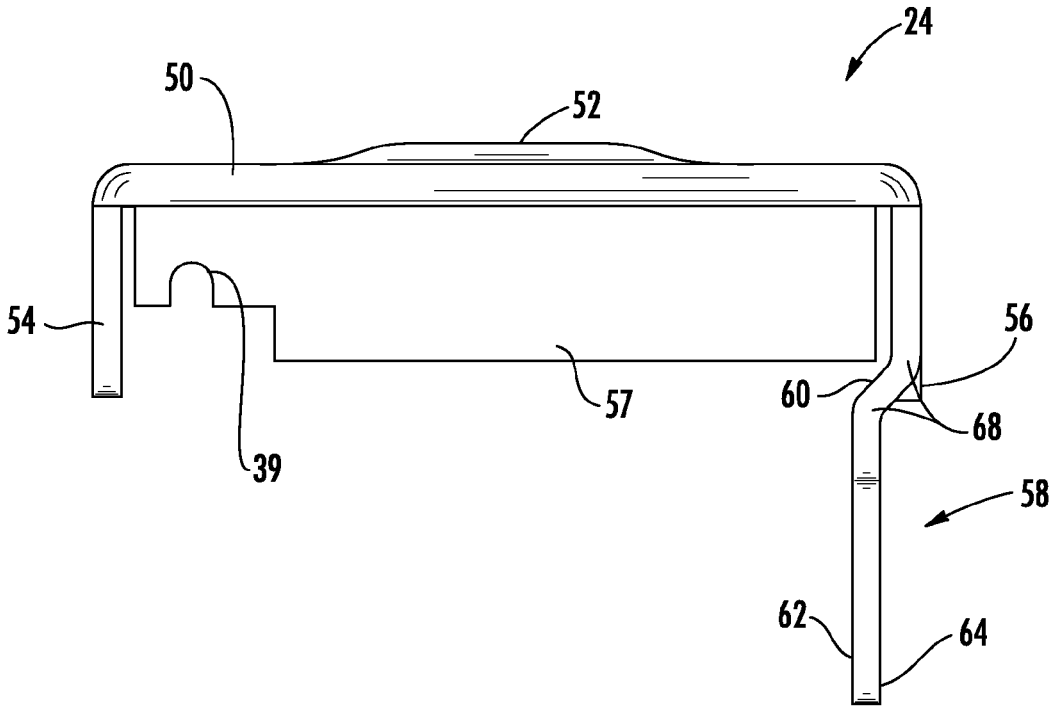
FIG. 6 is an end view of the paddle handle of the assembly of FIG. 1.
Figure 7:
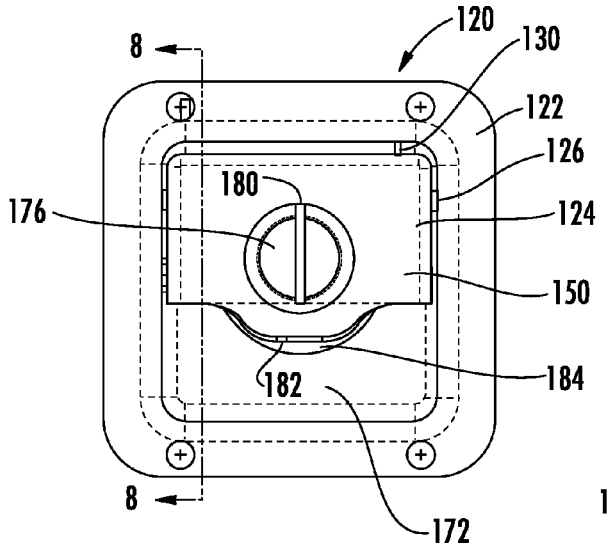
FIG. 7 is a front view of a second (locking) embodiment of a paddle handle assembly with cable eye according to the present disclosure.
Figure 8:
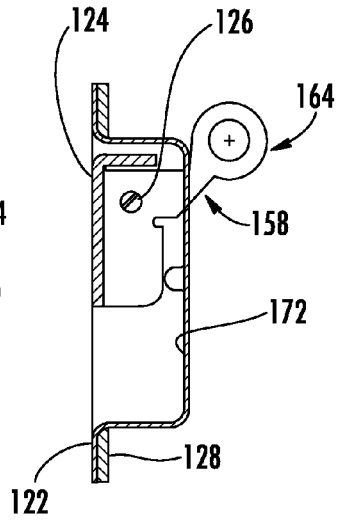
FIG. 8 is a cross-sectional view of the paddle handle assembly taken along lines 8-8 in FIG. 7.
Figure 9:
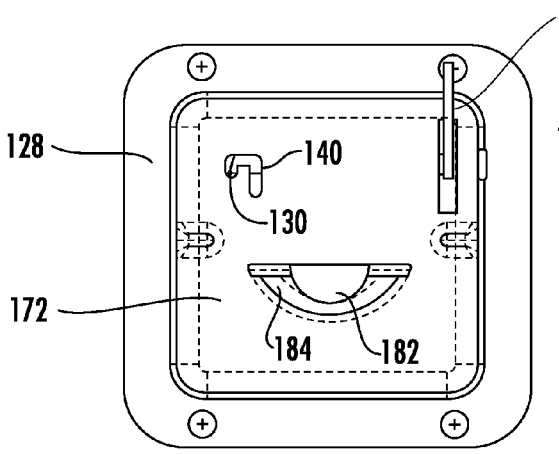
FIG. 9 is a rear view of the paddle handle assembly of FIG. 7.
Figure 10:
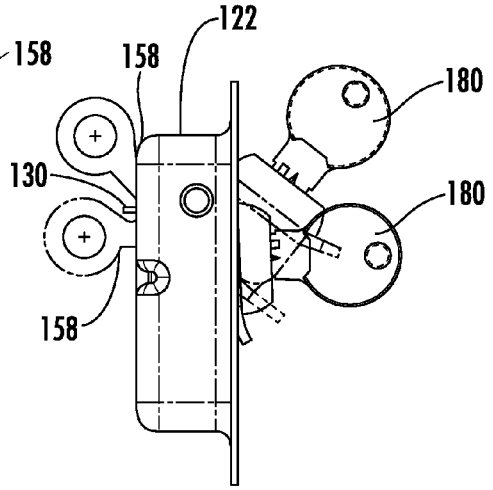
FIG. 10 is a side view of the paddle handle assembly of FIG. 7 showing the handle assembly in unactuated (solid lines) and actuated (dotted lines) positions.
Figure 11:
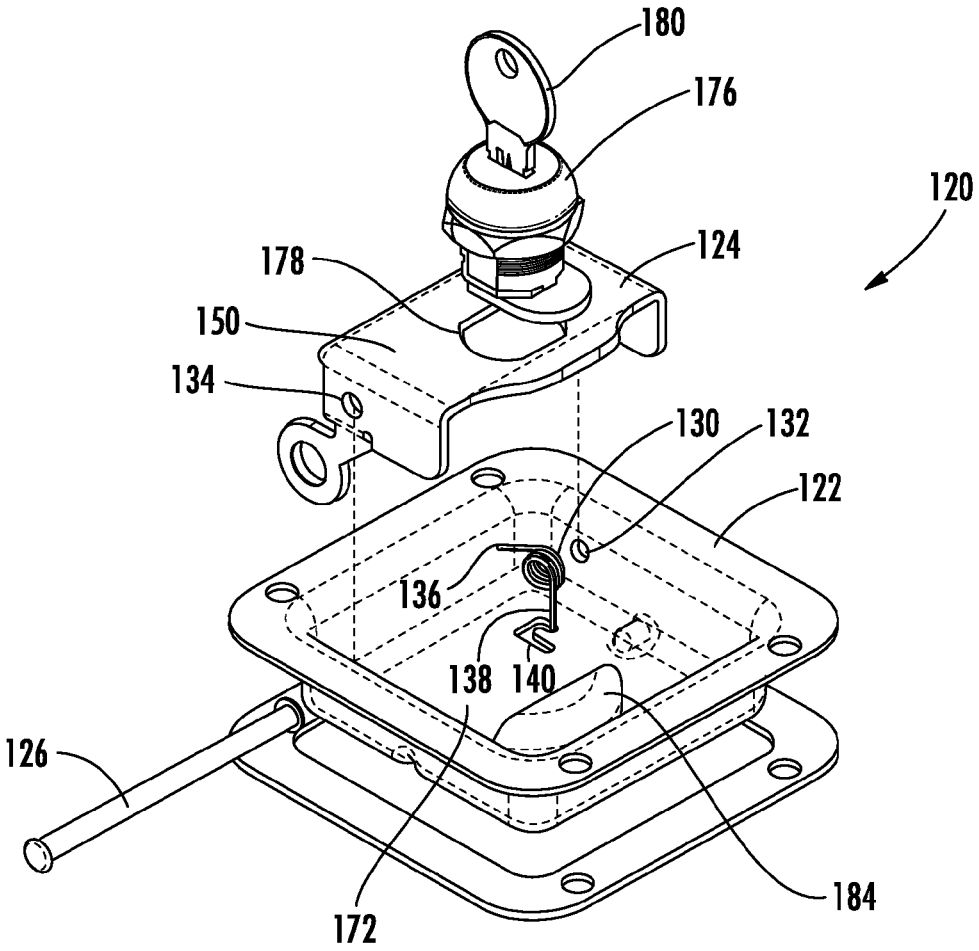
FIG. 11 is an isometric, exploded view of the paddle handle assembly of FIG. 7.

Detailed reference will now be made to the drawings in which examples embodying the present disclosure are shown. The detailed description uses numeral and letter designations to refer to features in the drawings. Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

Generally speaking, FIGS. 1-6 show a first (non-locking) embodiment of a paddle handle assembly 20, and FIGS. 7-11 show a second (locking) embodiment of a paddle handle assembly 120. Assemblies 20 and 120 are substantially similar, except for the presence or absence of elements related to the locking function, as will be discussed below. Accordingly, like or similar reference numerals will be used to refer to like or similar elements of the embodiments.

As shown in FIGS. 1-6, paddle handle assembly 20 includes a tray 22 and a paddle handle 24 pivotally mounted to the tray via an axle 26. A gasket 28 may be provided for placement between tray 22 and a surface to which it is mounted (not shown). A spring 30 may be used to urge paddle handle 24 toward a retracted position (e.g., as shown in FIG. 1).

Openings 32 and 34 may be provided in tray 22 and handle 24 for receiving axle 26. Spring 30 may be a coil spring mounted in compression to provide a restorative urging force to handle 24. One end 36 of spring 30 may contact handle 24 and the other end 38 may be contact tray 22, for example by being seated in slots 39,40. Other types of spring members and other locations for such spring members (whether on front side 42 or rear side 44 of tray 22) may be substituted. Openings 46 may be provided to receive fastening members (not shown) such as screws, rivets, etc., for mounting tray to the desired surface. Corresponding openings 48 may be provided on gasket 28 if present.

Handle 24 includes a front portion 50, a lip 52, sides 54,56 and a top 57. Openings 34 are located in sides 54,56 and slot 39 is located in top 57 (see FIG. 6). At least one of the sides (54, as shown) includes an actuating arm 58. Actuating arm 58 has a proximal end 60 extending from side 54 and a distal end 62 having a connector 64, in this case a cable eye. As illustrated cable eye connector 64 is a circular element with a centrally located circular opening 66 for receiving a cable attachment element (not shown). Other attachment structures could be used, with corresponding changes to the structure of connector 64.

Actuating arm 58 extends through a slot 67 in tray 22 so that much of the arm and the connector 64 are on rear side 44 of tray 22 whereas the rest of handle 24 is on front side 42 of tray 22. Actuating arm proximal end 60 has a double bend portion 68 that provides a lateral offset of actuating arm 58 with respect to side 54 of handle 22 (see FIG. 6). The offset of actuating arm 58 is in a direction toward the center of tray 22 and away from an adjacent side wall 70. Slot 67 is located correspondingly in tray 22 so as to be spaced along a flat portion 72 of the tray, as opposed to an adjacent curved portion 74 linking the flat portion and wall 70. Such offset provides clearance between arm 58 and wall 70 when handle 24 is moved between the rest and actuated positions. The location of slot 67 away from curved portion 74 and wall 70 provides a more secure tray design that is also easier to machine.

Handle 24, including cable eye connector 64, arm 58, double bend potion 68 and the remaining portions identified above, is made from a single unitary piece of metal, preferably a steel such as 1008/1010 steel. Cable eye connector 64 is formed directly from the unitary piece, not welded on, as might be done with certain other handles having such cable eye connectors. Although perhaps more complicated in terms of machining handle 22, not having to weld on the cable eye results in many advantages. For example, the manufacturer needs to stock fewer parts to make the handles, less tooling is required, labor savings are created by avoiding welding, potential quality/inspection concerns with respect the weld are eliminated, the handle is more dimensionally stable, and product longevity and performance are believed to be improved. Accordingly, the disclosed assembly 20 having a handle 24 with a unitary cable eye connector 64 provides many advantages not found in existing handles.

Handle assembly 120 of FIGS. 7-11 is substantially similar to that of handle assembly 20. Accordingly, reference numerals in the 100 series herein correspond to those mentioned above and all elements will not be discussed again for brevity. The view of the handle portion 24 as in FIG. 6 would be similar in handle assembly 120, so that view is not repeated.

As shown, handle assembly 120 includes a tray 122, a paddle handle 124, an axle 126, a gasket 128 and a spring 30, as above. Handle 124 is similar to handle 24 above, including side 154, actuating arm 158, cable eye connector 164, double bend portion 168, etc.

Handle assembly 120 also includes a locking mechanism including a lock cylinder 176 mountable to an opening 178 extending through handle front portion 150. Lock cylinder 176 is actuated by key 180 so as to rotate a locking arm 182, for example through 90 degrees, between a locked position and an unlocked position. When in the locking position, locking arm 182 is located beneath a catch 184 on tray 122. If desired, catch 184 may extend above flat portion 172 of tray 122. Catch 184 may, as illustrated, be integrally formed as part of tray 122 (for example by punching or piecing flat portion 172 to urge part of it upward to form catch 184). Alternatively, catch may be a slot or other opening formed in sidewalls of tray 122, or may be a separate piece attached (e.g., welded) to tray flat portion 172. Regardless, catch 184 functions to receive locking arm 182 when lock cylinder 176 is rotated to the locked potion, thereby preventing movement of the handle from the unactuated (solid lines) position of FIG. 9 to the actuated (dotted lines) position of FIG. 9.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. Thus, while particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

I claim:

1. A paddle handle assembly comprising:

a tray;

a handle pivotally mounted to the tray;

a spring for urging the handle toward an unactuated positon with respect to the tray; and an arm integrally formed with the handle and extending through the tray, a distal end of the arm including a cable eye connector integrally formed with the arm for actuating a securing mechanism on a rear side of the tray.

2. The paddle handle assembly of claim 1, further including a double bend at a proximal end of the arm for creating an offset between the cable eye connector and a side of the handle.

3. The paddle handle assembly of claim 1, further including a locking mechanism mounted to the handle for preventing actuation of the handle relative to the tray.

4. The paddle handle assembly of claim 3, wherein the tray includes a catch for receiving a locking arm of the locking assembly.

5. The paddle handle assembly of claim 4, wherein the catch is formed integrally with the tray.

6. A paddle handle assembly comprising:

a tray;

a handle pivotally mounted to the tray;

a spring for urging the handle toward an unactuated positon with respect to the tray;

an arm integrally formed with the handle and extending through the tray, a distal end of the arm including a cable eye connector integrally formed with the arm for actuating a securing mechanism on a rear side of the tray, the arm including a double bend at a proximal end of the arm for creating an offset between the cable eye connector and a side of the handle; and a locking mechanism mounted to the handle for preventing actuation of the handle relative to the tray.

7. The paddle handle assembly of claim 6, wherein the tray includes a catch for receiving a locking arm of the locking assembly.

8. The paddle handle assembly of claim 7, wherein the catch is formed integrally with the tray.

* * * * *